US010676309B2

(12) United States Patent
Berendes

(10) Patent No.: US 10,676,309 B2
(45) Date of Patent: Jun. 9, 2020

(54) CASH BOX HAVING A STORAGE AREA FOR STORING NOTES OF VALUE

(71) Applicant: Wincor Nixdorf International GmbH, Paderborn (DE)

(72) Inventor: Elmar Berendes, Warburg (DE)

(73) Assignee: Wincor Nixdorf International, GmbH, Paderborn (DE)

( * ) Notice: Subject to any disclaimer, the term of this patent is extended or adjusted under 35 U.S.C. 154(b) by 0 days.

(21) Appl. No.: 16/028,890

(22) Filed: Jul. 6, 2018

(65) Prior Publication Data

US 2019/0012869 A1 Jan. 10, 2019

(30) Foreign Application Priority Data

Jul. 7, 2017 (DE) ..... 10 2017 115 203

(51) Int. Cl.
*B65H 43/08* (2006.01)
*B65H 31/10* (2006.01)
(Continued)

(52) U.S. Cl.
CPC ..... *B65H 43/08* (2013.01); *B65H 1/20* (2013.01); *B65H 31/10* (2013.01); *B65H 43/02* (2013.01); *G07D 11/125* (2019.01); *G07D 11/13* (2019.01); *B65H 2404/1114* (2013.01); *B65H 2553/412* (2013.01); *B65H 2553/612* (2013.01);
(Continued)

(58) Field of Classification Search
CPC ... B65H 43/02; B65H 43/08; B65H 2553/412
See application file for complete search history.

(56) References Cited

U.S. PATENT DOCUMENTS 6,279,899 B1 * 8/2001 Coffey ..... B65H 31/26 270/58.02
9,067,753 B2 6/2015 Tokuma et al.
(Continued)

FOREIGN PATENT DOCUMENTS

DE 102008018935 A1 10/2009
EP 2014593 A2 1/2009
EP 2738745 A1 4/2014

OTHER PUBLICATIONS

Extended European Search Report issued in corresponding European Application No. 1818159.1; 7 pages.

*Primary Examiner* — Howard J Sanders
(74) *Attorney, Agent, or Firm* — Black, McCuskey, Souers & Arbaugh, LPA

(57) ABSTRACT

A cash box has a storage area for storing several notes of value and a counterpressure unit, which delimits the storage area and is movable between first and second positions. The cash box includes a sensor unit with at least one sensor element, the sensor unit emitting a sensor signal that is dependent on the position of the sensor element. The counterpressure unit has a recess for receiving at least a part of the sensor element. The sensor element and the recess are arranged such that the sensor element is only received whenever the counterpressure unit is in the first position and no note of value is present between the sensor element and the recess. The cash box has a control unit which determines on the basis of the sensor signal of the sensor unit and the position of the counterpressure unit whether the cash box is empty.

15 Claims, 9 Drawing Sheets

(51) Int. Cl.

| | |
|---|---|
| ***B65H 43/02*** | (2006.01) |
| ***G07D 11/125*** | (2019.01) |
| ***G07D 11/13*** | (2019.01) |
| ***B65H 1/20*** | (2006.01) |
| *G07D 11/23* | (2019.01) |

(52) U.S. Cl.
CPC ..... *B65H 2701/1912* (2013.01); *G07D 11/23* (2019.01); *G07D 2211/00* (2013.01)

(56) References Cited

U.S. PATENT DOCUMENTS

| | | | | |
|---|---|---|---|---|
| 10,053,313 | B2 * | 8/2018 | Akamatsu ..... | B65H 7/14 |
| 2013/0277382 | A1 | 10/2013 | Lees et al. | |

* cited by examiner

CASH BOX HAVING A STORAGE AREA FOR STORING NOTES OF VALUE

CROSS-REFERENCE TO RELATED APPLICATIONS

This application claims priority to and the benefit of German Patent Application DE 10 2017 115 203.2 filed Jul. 7, 2017, the contents of which are hereby incorporated by reference in their entirety.

BACKGROUND AND SUMMARY

This relates to a cash box having a storage area in which several notes of value are storable as a value note stack. A counterpressure unit delimiting the storage area is movable in a deposit direction and opposite to the deposit direction between a first position in which the storage area has a minimum volume and a second position in which the storage area has a maximum volume.

From the prior art, cash boxes are known in which counterpressure units movable in deposit direction and opposite to the deposit direction are provided for exerting a counterpressure force on the value note stack. These counterpressure units enable a safe deposit of the notes of value in that they keep already stored notes of value in stacked form, the stacking direction extending vertically or horizontally. From document DE 10 2008 018 935 A1, for example a single sheet handling device is known, in which the notes of value are stacked horizontally, i.e. standing on an edge. From document EP 2 738 745 A1, a cash box is known in which the notes of value are stacked vertically, i.e. lying on their front or back.

When changing the cash box or when determining the stock, it has to be checked whether notes of value are still present in the cash box. From the prior art, no solutions are known in which it can be detected by a simple check whether a cash box is empty. Thus, for example, a check of the position of the counterpressure unit is mostly not sufficient for this detection due to the small height of the notes of value, because the measuring accuracy is usually not so high that even the presence of a single note of value can reliably be determined.

For a cash box for storing notes of value in a storage area, it can be determined by way of a simple check whether the cash box is empty.

By way of the cash box, it is determined with the aid of a control unit whether the cash box is empty, the determination being accomplished on the basis of the sensor signal of the sensor unit and the position of the counterpressure unit. The sensor signal is in particular dependent on the position of the sensor element of the sensor unit, which sensor unit can be received in a recess of the counterpressure unit. The sensor element and the recess are arranged and designed such that the sensor element is only received in the recess whenever the counterpressure unit is in the first position and no note of value is present between the sensor element and the recess. As a result, an easy and reliable determination and check of the empty condition of the cash box is possible. The sensor signal can be transmitted as a signal level via control lines or encoded in data, in particular with the aid of data packets, from the sensor unit to the control unit.

It is advantageous when the sensor unit detects a first sensor element position of the sensor element when there is at least one note of value between the sensor element and the counterpressure unit that contacts the sensor element with its front or back, wherein the sensor element is moved opposite to the deposit direction by the contact with the note of value. As a result, it is guaranteed that the presence of a note of value is detected whenever the counterpressure unit is in a position in which the note of value can contact the sensor element.

It is particularly advantageous when the control unit detects the condition 'cash box empty' when the counterpressure unit is in the first position and the sensor element is not in the first sensor element position. Further, it is advantageous when the control unit detects the condition 'cash box not empty' when the counterpressure unit is in the first position and the sensor element is in the first sensor element position. As a result, an easy and reliable detection of the conditions 'cash box empty' and 'cash box not empty' is possible.

It is advantageous when several notes of value stored in the storage area form a value note stack. In an operating position of the cash box, the notes of value of the value note stack can be arranged on top of one another such that the lowest note of value rests on the counterpressure unit with its front or back. As a result, a safe and reliable deposit of the notes of value is possible.

It is particularly advantageous when during the feed of notes of value into the cash box the control unit controls the counterpressure unit based on the sensor signal that the sensor element is in the first sensor element position such that the counterpressure unit is moved in deposit direction until the sensor element is no longer in the first sensor element position and the sensor unit outputs a corresponding sensor signal.

As a result, above the value note stack a feed gap can be formed into which further notes of value may be fed.

Further, it is advantageous when the sensor unit comprises a detection element, wherein the detection element generates the sensor signal as to whether the sensor element is arranged in the first sensor element position or not and transmits it to the control unit. The detection element preferably comprises at least one light barrier. Thus, the sensor element position can be detected accurately by the sensor unit.

It is particularly advantageous when a feeding and/or separating unit for feeding and/or removing the notes of value is provided, wherein the notes of value are feedable or removable individually one after the other to or from the storage area with the aid of the feeding and separating unit. As a result, notes of value can be fed to the storage area and removed from the storage area in an easy manner.

In an advantageous embodiment a drive unit for moving the counterpressure unit is provided, in particular an electric motor, such as a direct current motor or a stepper motor. As a result, an easy drive of the counterpressure unit is possible. It is particularly advantageous when the control unit determines the first position of the counterpressure unit in which the counterpressure unit bears against a stop with the aid of a current measurement of the motor current of the electric motor or with the aid of a step counting of the stepper motor. This makes a reliable determination of the first position of the counterpressure unit possible.

Further, it is advantageous when the counterpressure unit is firmly connected with at least one belt, the belt being driven by the drive unit so that an easy and cost-efficient drive of the counterpressure unit is possible.

It is particularly advantageous when the recess of the counterpressure unit has a width of 5 mm to 7 mm, in particular 5.5 to 6 mm, and when the sensor element that is received in the recess has a width of 2 mm to 4 mm, in particular 2.5 mm to 3 mm.

Various aspects will become apparent to those skilled in the art from the following detailed description and the accompanying drawings.

DETAILED DESCRIPTION

Figure 1:
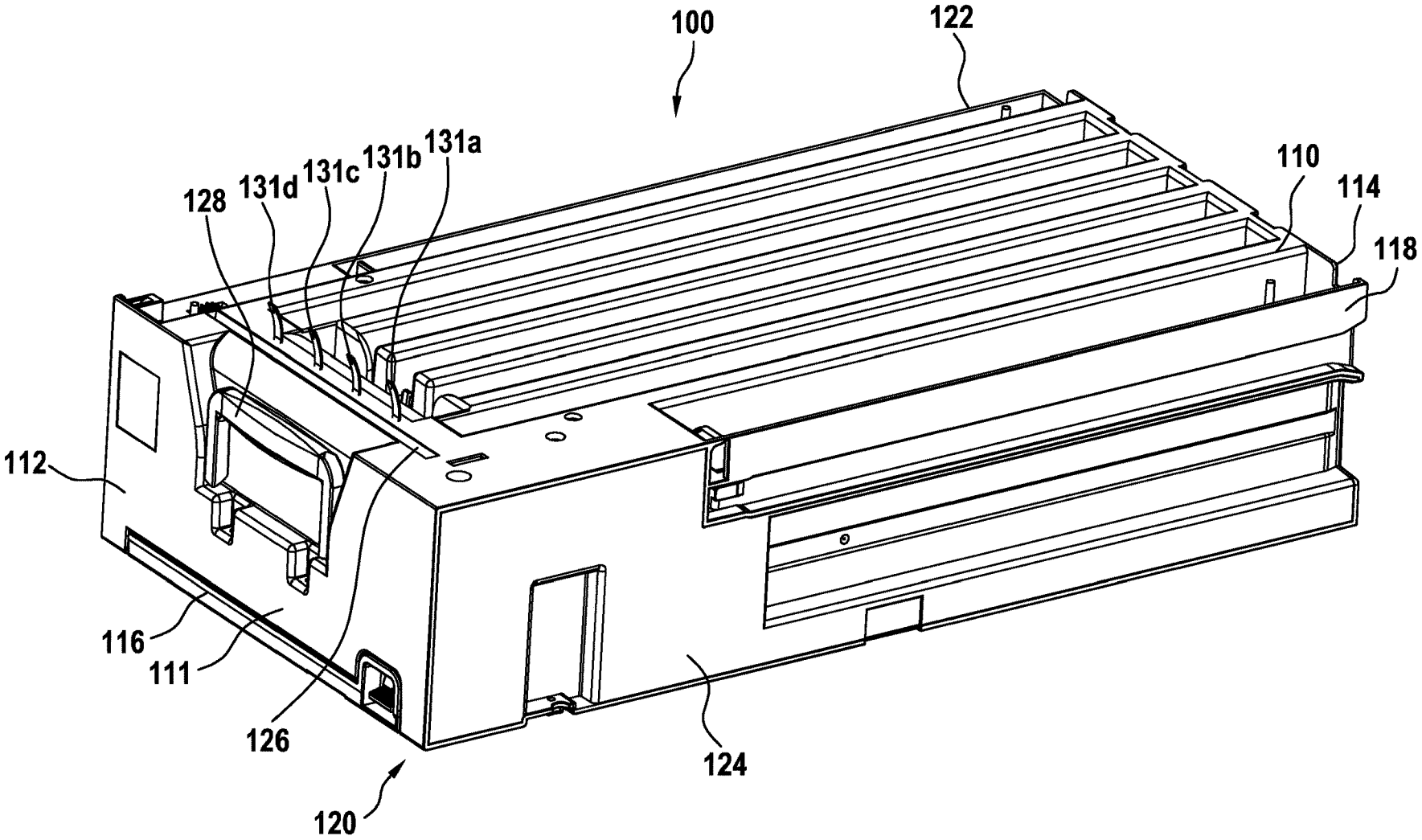
FIG. 1 shows a perspective illustration of a cash box in a horizontal position.

FIG. 1 shows a perspective illustration of a cash box 100 in a horizontal position. The cash box 100 has a housing 120 with a basic body 112 comprising a front 110, a top 111, a bottom 114 and two lateral boundaries 118, 122. The two lateral boundaries 118, 122 of the basic body 112 are each partially covered by a cover plate 124, wherein in FIG. 1 only one of the two cover plates 124 being visible as a result of the chosen perspective. The rear of the housing 120 of the cash box 100 is formed by a cover plate 116 connected to the housing 120. In FIG. 1, moreover a handle 128 for transporting the cash box 100, a feed slot 126 for feeding non-illustrated notes of value 10 as well as four vanes 131*a*, 131*b*, 131*c*, 131*d* are shown, which project from the housing 120 and form part of four vane wheels 130*a* to 130*d*.

Figure 2:
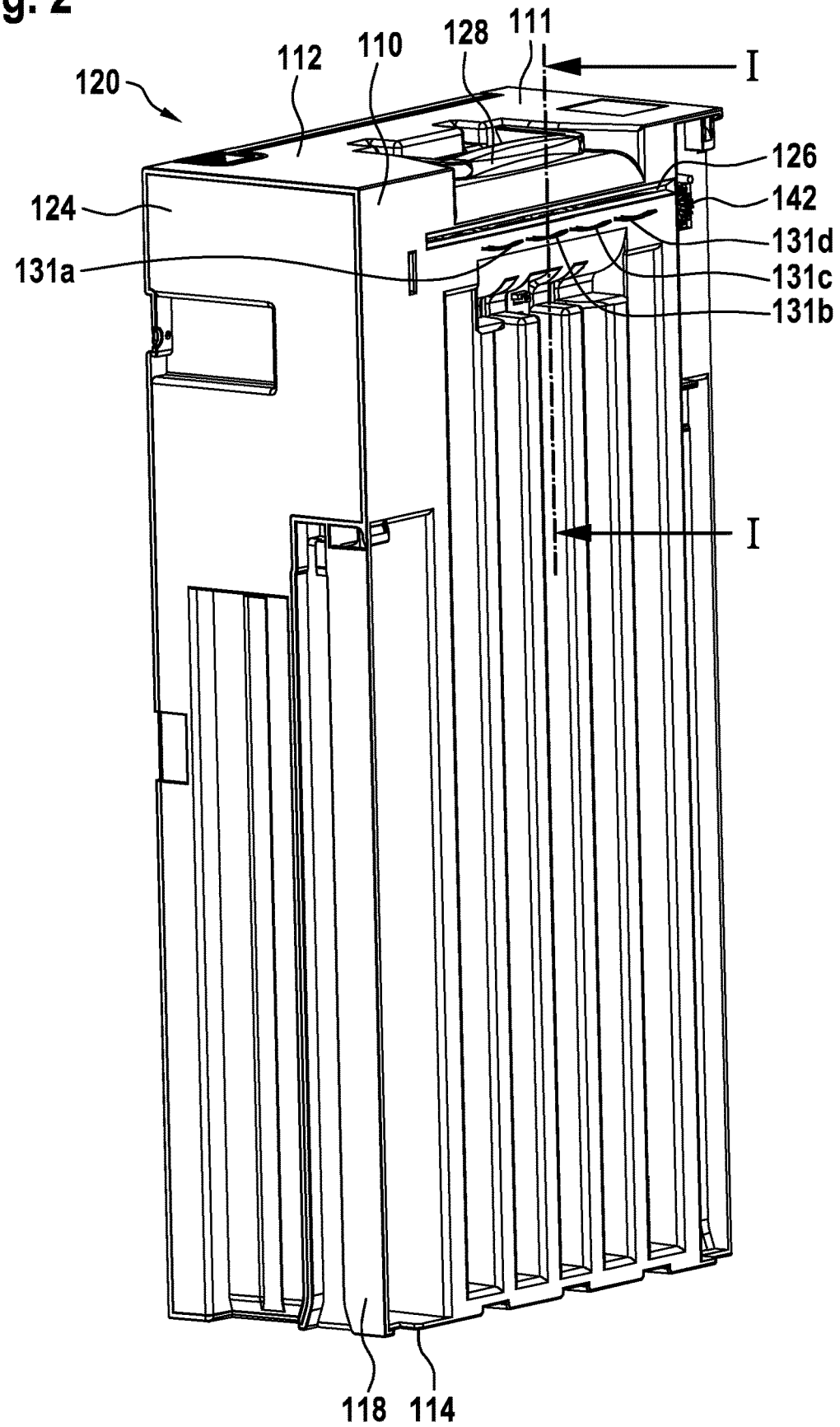
FIG. 2 shows a perspective illustration of the cash box according to FIG. 1 in a vertical position.

FIG. 2 shows a perspective illustration of the cash box 100 according to FIG. 1 in a vertical position. Elements having the same structure or the same function are identified with the same reference signs. In the embodiment, the vertical position of the cash box 100 illustrated in FIG. 2 corresponds to the operating position of the cash box 100, in which the cash box 100 is inserted in a device for handling notes of value 10. In FIG. 2, a gearwheel 142 is visible which is engaged with a non-illustrated drive unit provided outside the cash box 100 when the cash box 100 has for example been inserted into a device for handling notes of value, such as an automated teller machine or an automatic cash safe or an automatic cash register system.

Figure 3:
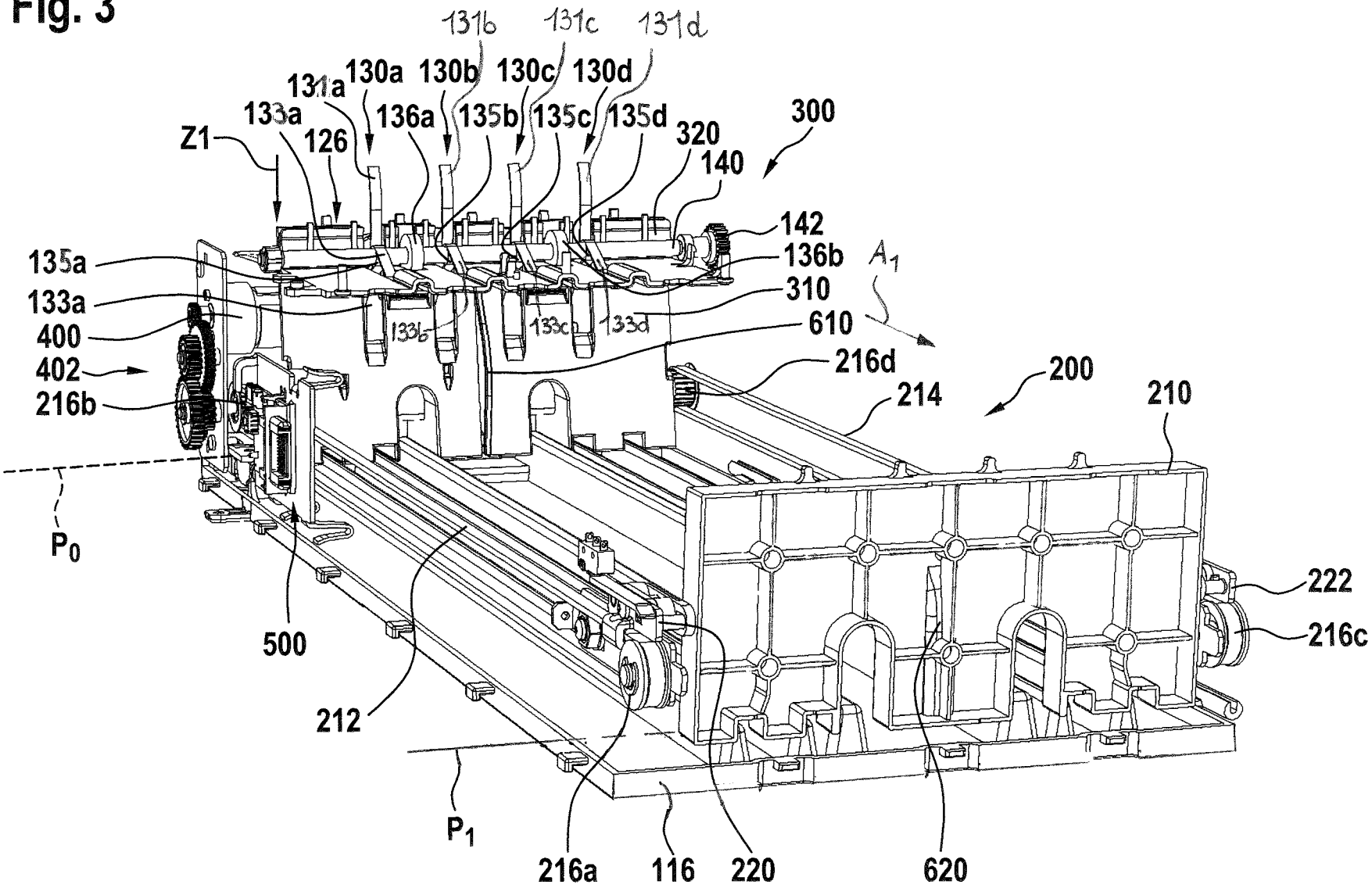
FIG. 3 shows a perspective illustration of the inner structure of the cash box according to FIGS. 1 and 2 in a first operating state.

FIG. 3 shows a perspective illustration of the inner structure of the cash box 100 according to FIGS. 1 and 2 in a first operating state. The cash box 100 comprises a feed unit 300 for feeding non-illustrated notes of value 10 and a storage area 200 in which the notes of value 10 are stored. The storage area 200 is delimited by a counterpressure unit 210, which is firmly connected with a belt 212 via a first connecting element 220 and is firmly connected with a belt 214 via a second connecting element 222. The belt 212 is guided over rollers 216*a* and 216*b* serving as deflecting elements, and the belt 214 is guided over rollers 216*c* and 216*d* serving as deflecting elements.

The rollers 216*b* and 216*d* are fixedly arranged on a drive shaft 221 not visible in FIG. 3, which shaft is drivable by a drive unit 400, a gear stage 402, in particular a transmission gear, being provided for transmitting the drive force of the drive unit 400 onto the drive shaft 221. The rollers 216*a* and 216*c* are arranged on a non-driven shaft 223 that is covered by the counterpressure unit 210 in FIG. 3.

In FIG. 3, the counterpressure unit 210 is illustrated in a first operating state in which the counterpressure unit 210 is arranged at a second position shown by the line P1, the volume of the storage area 200 being at its maximum in this second position P1. By way of the drive unit 400, the counterpressure unit 210 can be moved opposite to a deposit direction A1 and in deposit direction A1 between the line P1 and a line P0. The line P0 indicates a position of a mechanical stop element, which, in this embodiment, corresponds to a stop of a delimiting element 310. When the counterpressure unit 210 is arranged at the first position indicated by the line P0, the volume of the storage area 200 is at a minimum.

A control unit 500 monitors the position of the counterpressure unit 210 and controls the drive unit 400, wherein the drive unit 400 comprises a direct current motor in this embodiment. The control unit 500 measures the motor current and detects whether the counterpressure unit 210 is in the first position, i.e. at the line P0, when the counterpressure unit 210 is pressed against the stop or against the delimiting element 310 by the drive unit 400 so that the motor current increases. In an alternative embodiment, the drive unit 400 may also comprise a stepper motor instead of the direct current motor, wherein the position determination of the counterpressure unit 210 is accomplished with the aid of a step counting of the stepper motor by the control unit 500. Further, alternatively or additionally, a further sensor unit for detecting the position of the counterpressure unit 210 may be provided.

In the present embodiment, the feed unit 300 comprises four vane wheels 130*a* to 130*d*, which are arranged on a drive shaft 140 in a rotationally fixed manner and each, have three vanes 131*a* to 133*d* projecting tangentially from a hub 135*a* to 135*d*. The drive shaft 140 is driven for feeding notes of value 10 into the storage area 200 with the aid of a further non-illustrated drive unit, wherein the connection of the shaft 140 with the further drive unit is accomplished via the gearwheel 142 that is connected with the shaft 140 in a rotationally fixed manner and that projects from the housing 120 of the cash box 100. Between the vane wheels 130*a* to 130*b* a drive roller 136*a* and between the vane wheels 130*c* and 130*d* a drive roller 136*b* is respectively connected with the shaft 140 in a rotationally fixed manner. The two drive rollers 136*a* and 136*b* project into the feed slot 126, which is delimited, by the delimiting element 310 and a second delimiting element 320. Opposite to the two drive rollers 136*a* and 136*b*, one non-driven roller 138*a* and 138*b*, respectively, is arranged, which are covered in FIG. 3 by the drive rollers 136*a* and 136*b* and serve as press-on rollers 138*a*, 138*b*.

When feeding a note of value, the shaft 140 is rotated, which in turn rotates the vane wheels 130*a* to 130*d* and the drive rollers 136*a* and 136*b*. With the aid of the drive rollers 136*a* and 136*b*, the note of value is fed through the feed slot 126 in a feed direction Z1, wherein the note of value is pressed against the rollers 138*a* and 138*b* and thus causes a rotation of the two rollers 138*a* and 138*b*. After passing through the feed slot 126, at least one vane 131*a* to 133*d* contacts the note of value and pushes it into the storage area 200 of the cash box 100 in deposit direction A1.

As shown in FIG. 3, the cash box 100 comprises a sensor element 610, which in the described embodiment has the shape of a skid or a lever. The sensor element 610 has a width of 2 mm to 4 mm, in particular 3 mm and has a weight of 2 g to 5 g, in particular 3 g. The sensor element 610 can be received in a recess 620 of the counterpressure unit 210 when the counterpressure unit 210 is in the first position P0. The recess 620 of the counterpressure unit 210 has a width of 5 mm to 7 mm, in particular 5.5 mm to 6 mm.

Figure 4:
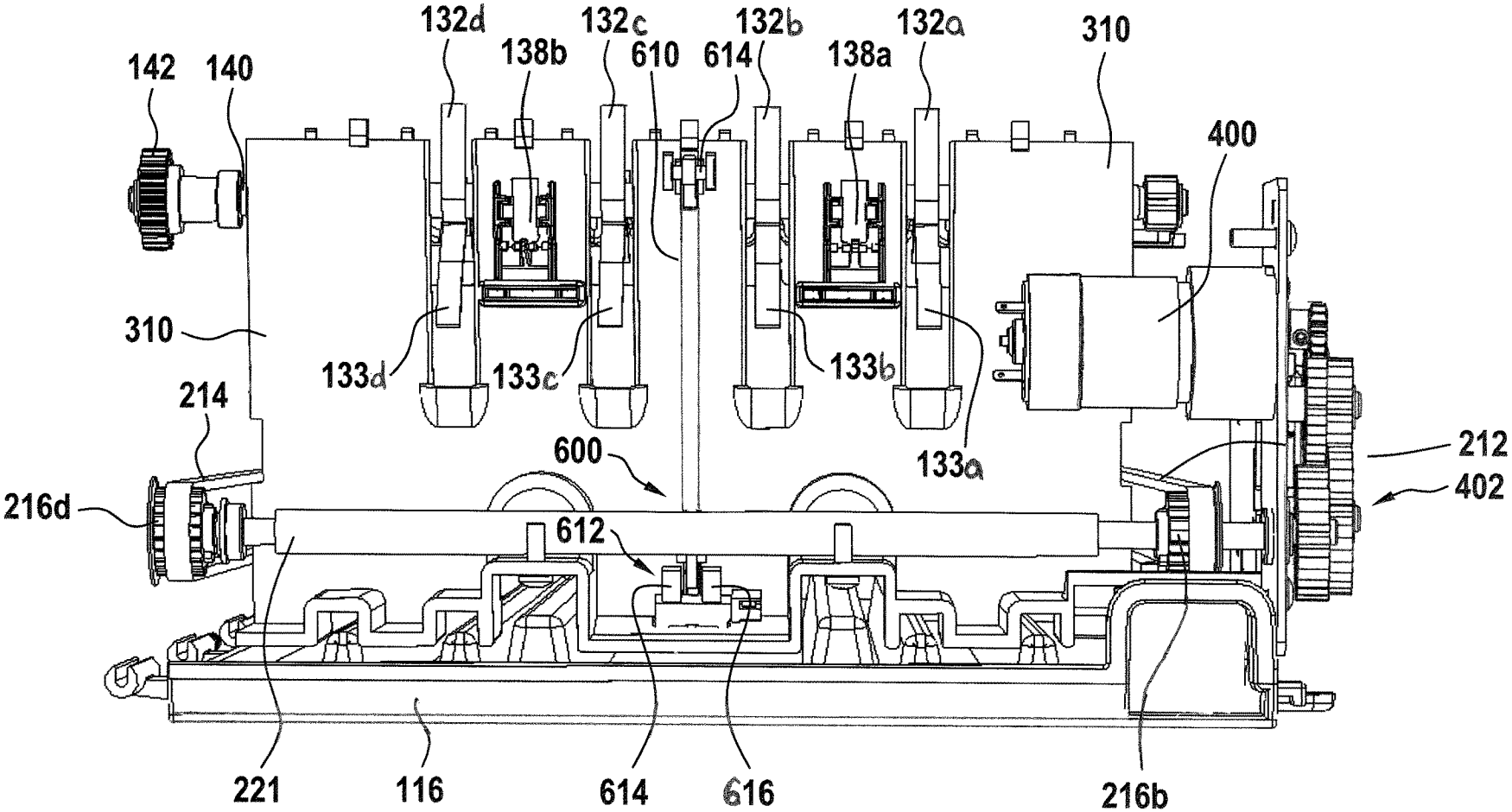
FIG. 4 shows a top view of the inner structure of the cash box according to FIGS. 1 to 3.

FIG. 4 shows a top view of the inner structure of the cash box 100 according to FIGS. 1 to 3. The sensor element 610 is pivotally connected with the delimiting element 310 by a connecting element 618. In the horizontal position of the cash box 100 illustrated in FIG. 4, the sensor element 610 projects into a light barrier arrangement 612. In the vertical operating position of the cash box 100, the sensor element 610, in the operating state illustrated in FIG. 3, is moved out of the light barrier arrangement 612 in deposit direction A1 by gravity.

The light barrier arrangement 612 comprises an optical transmitter 614 for emitting light and an optical receiver 616 for receiving the light emitted by the transmitter 614. The transmitter 614 and the receiver 616 are arranged such that given a positioning of the sensor element 610 between the optical transmitter 614 and the optical receiver 616 the light beam emitted by the transmitter 614 is interrupted. This interruption is detected by the receiver 616, which transmits a corresponding first sensor signal to the control unit 500. The sensor element 610 and the light barrier arrangement 612 that serves as a detecting element together form a sensor unit 600.

Figure 5:
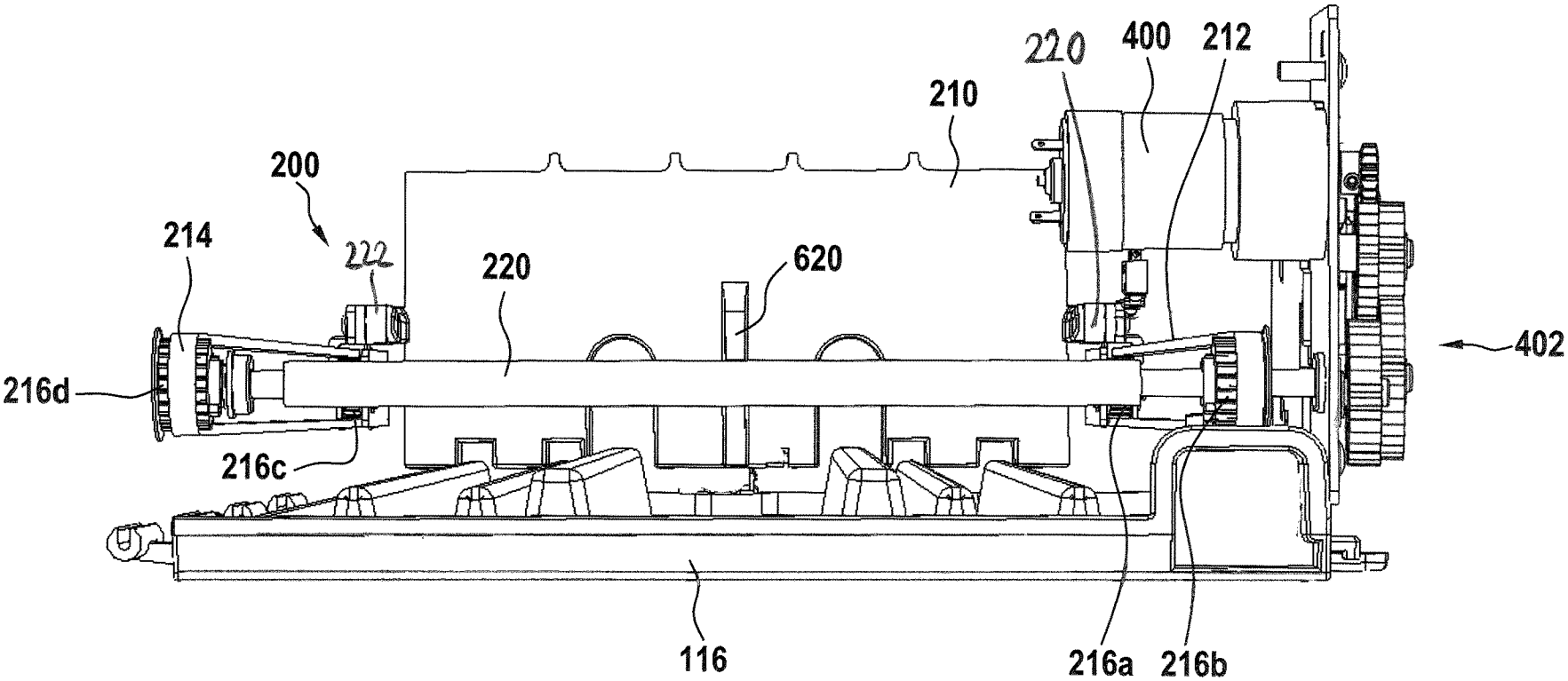
FIG. 5 shows a perspective illustration of a part of the inner structure of the cash box according to FIGS. 1 to 4.

FIG. 5 shows a perspective illustration of a part of the inner structure of the cash box according to FIGS. 1 to 4, in which the counterpressure unit 210 with the recess 620 and elements for moving the counterpressure unit 210 in the storage area 200 from the first position P0 in the direction of the second position P1, i.e. in deposit direction A1, as well as in opposite direction, are visible.

Figure 6:
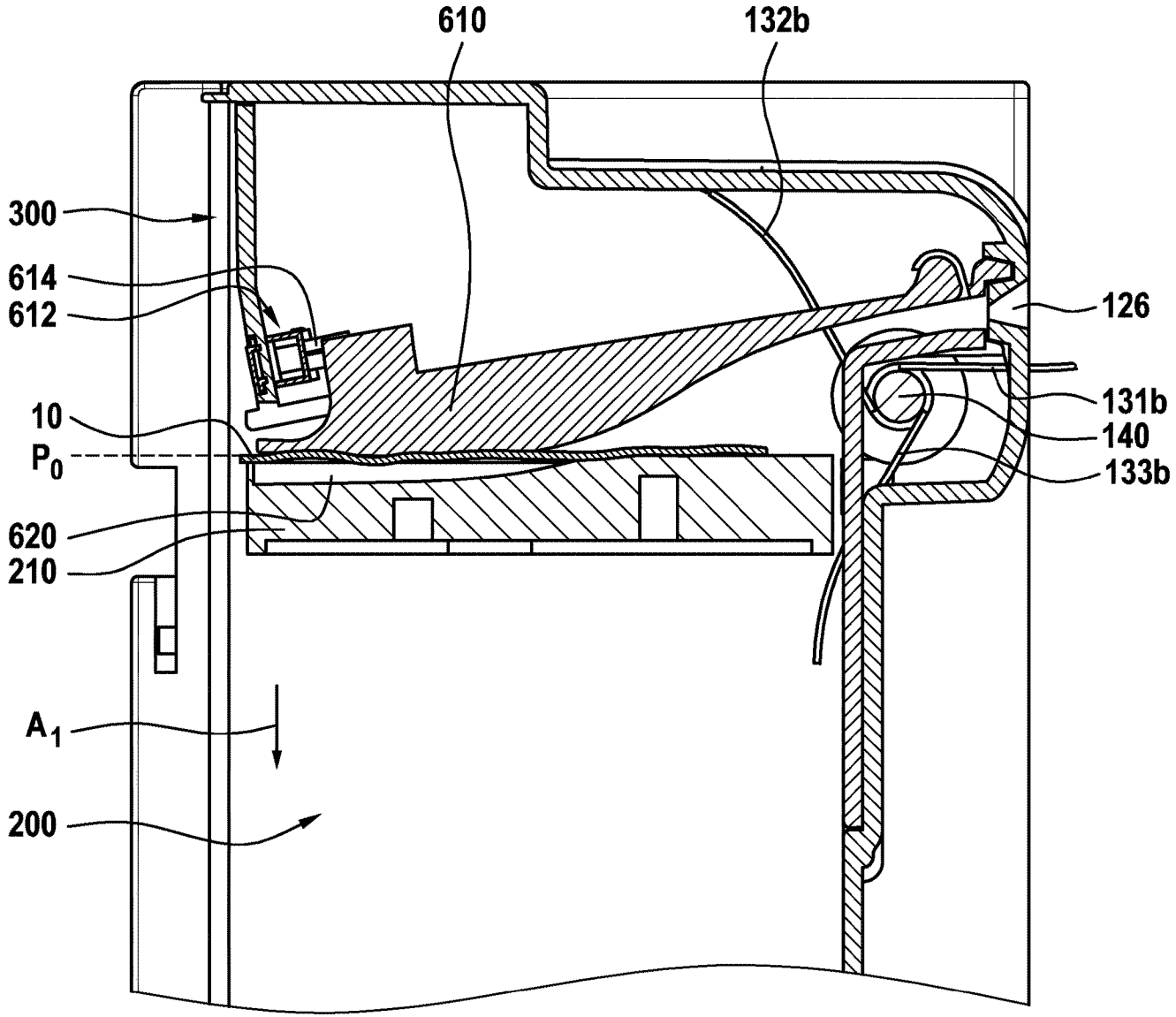
FIG. 6 shows a vertical sectional view of the cash box according to FIGS. 1 to 5 along the line of section I-I in a second operating state.

FIG. 6 shows a vertical sectional view according to FIGS. 1 to 5 along the line of section I-I in a second operating state, in which the counterpressure unit 210 is positioned at the first position P0 so that the storage area 200 has the smallest volume. For this, the counterpressure unit 210 has been moved with the aid of the drive unit 400 opposite to the deposit direction A1 up to the line P0. A note of value 10 which is arranged between the counterpressure unit 210 and the sensor element 610 contacts the sensor element 610 and deflects it opposite to the deposit direction A1 into a first sensor element position in which the sensor element 610 interrupts the light beam between the transmitter 614 and the receiver 616 of the light barrier arrangement 612. The receiver 616 emits a corresponding first sensor signal to the control unit 500 which detects from this first sensor signal and the information that the counterpressure unit is in the first position the condition 'cash box not empty'.

Figure 7:
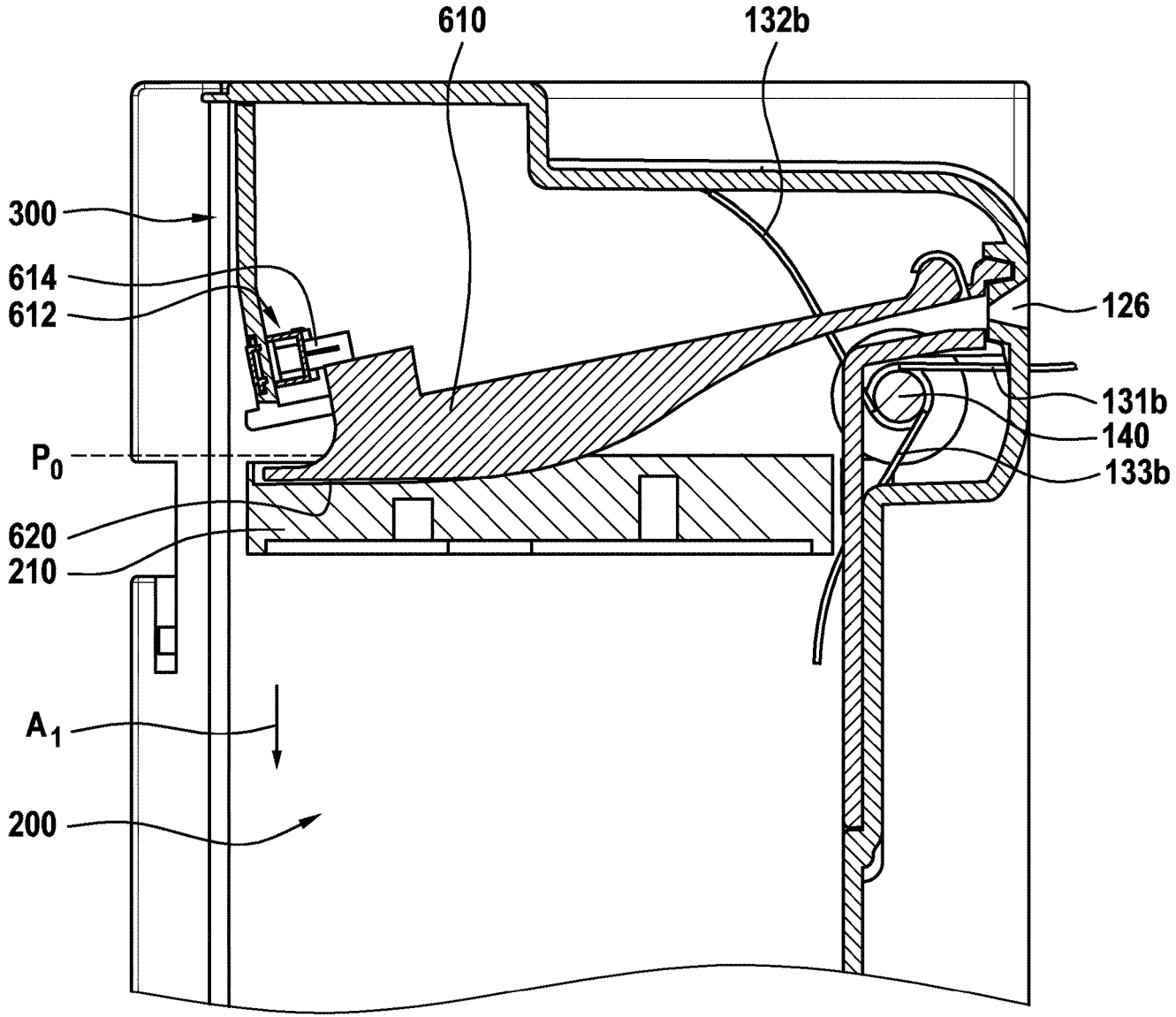
FIG. 7 shows a vertical sectional view of the cash box according to FIGS. 1 to 6 along the line of section I-I in a third operating state.

FIG. 7 shows a vertical sectional view of the cash box according to FIGS. 1 to 6 along the line of section I-I in a third operating state in which the counterpressure unit 210, as in the second operating state shown in FIG. 6, is positioned at the first position P0, i.e. the storage area 200 has the smallest volume. For this, the counterpressure unit 210 has been moved with the aid of the drive unit 400 opposite to the deposit direction A1 up to the line P0 so that it bears against the stop of the delimiting element 310. In contrast to the second operating state, no note of value is present between the sensor element 610 and the counterpressure unit so that a part of the sensor element 610 is received in the recess of the counterpressure unit 210. As a result, the light beam between the transmitter 614 and the receiver 616 is not interrupted so that the receiver 616 transmits a corresponding second sensor signal to the control unit 500. From the information that the counterpressure unit is in the first position and the second sensor signal that the light beam of the light barrier arrangement 612 is not interrupted by the sensor element 610, the control unit 500 determines the condition 'cash box empty'.

Figure 8:
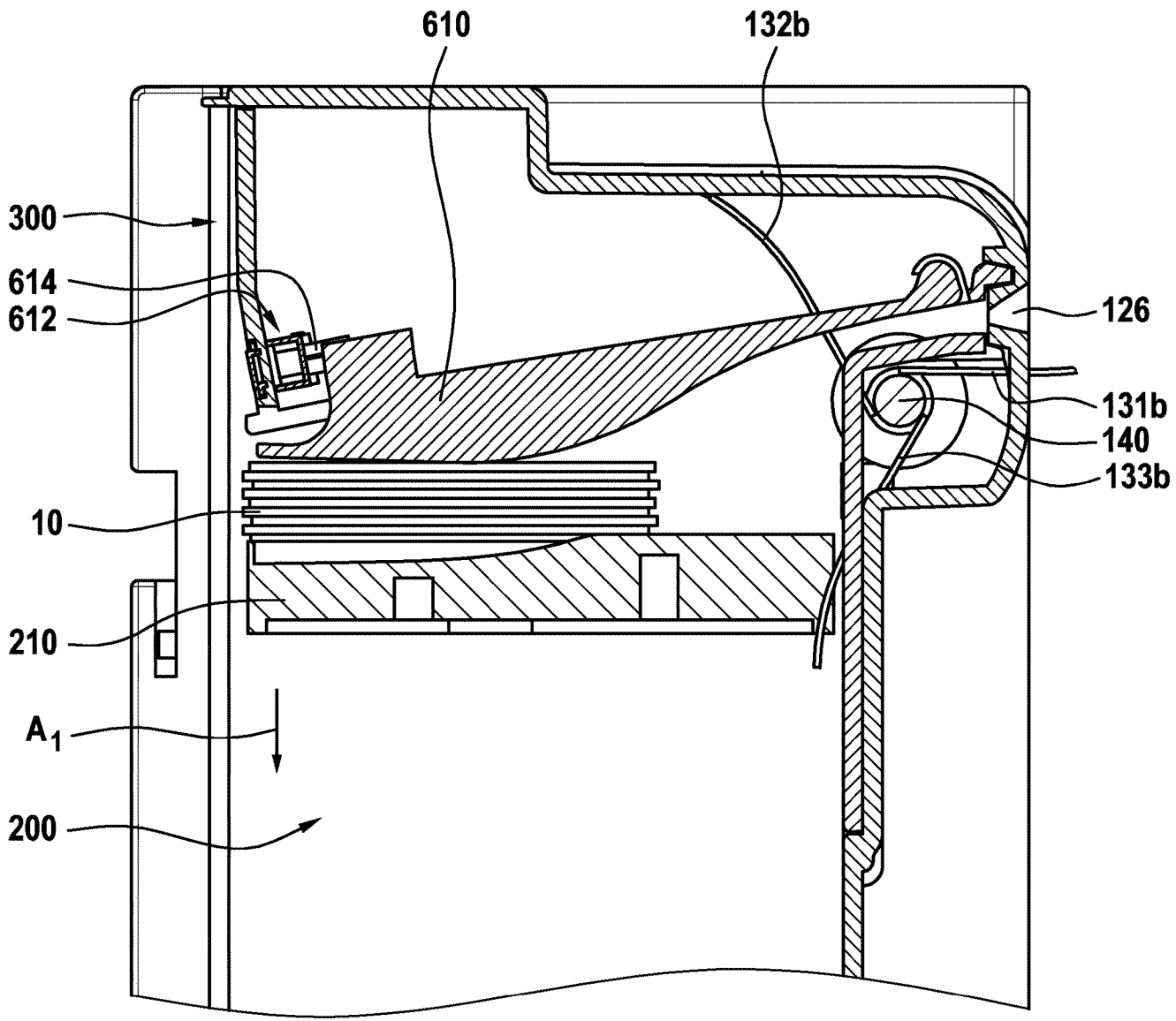
FIG. 8 shows a vertical sectional view according to FIGS. 1 to 7 along the line of section I-I in a fourth operating state.
Figure 9:
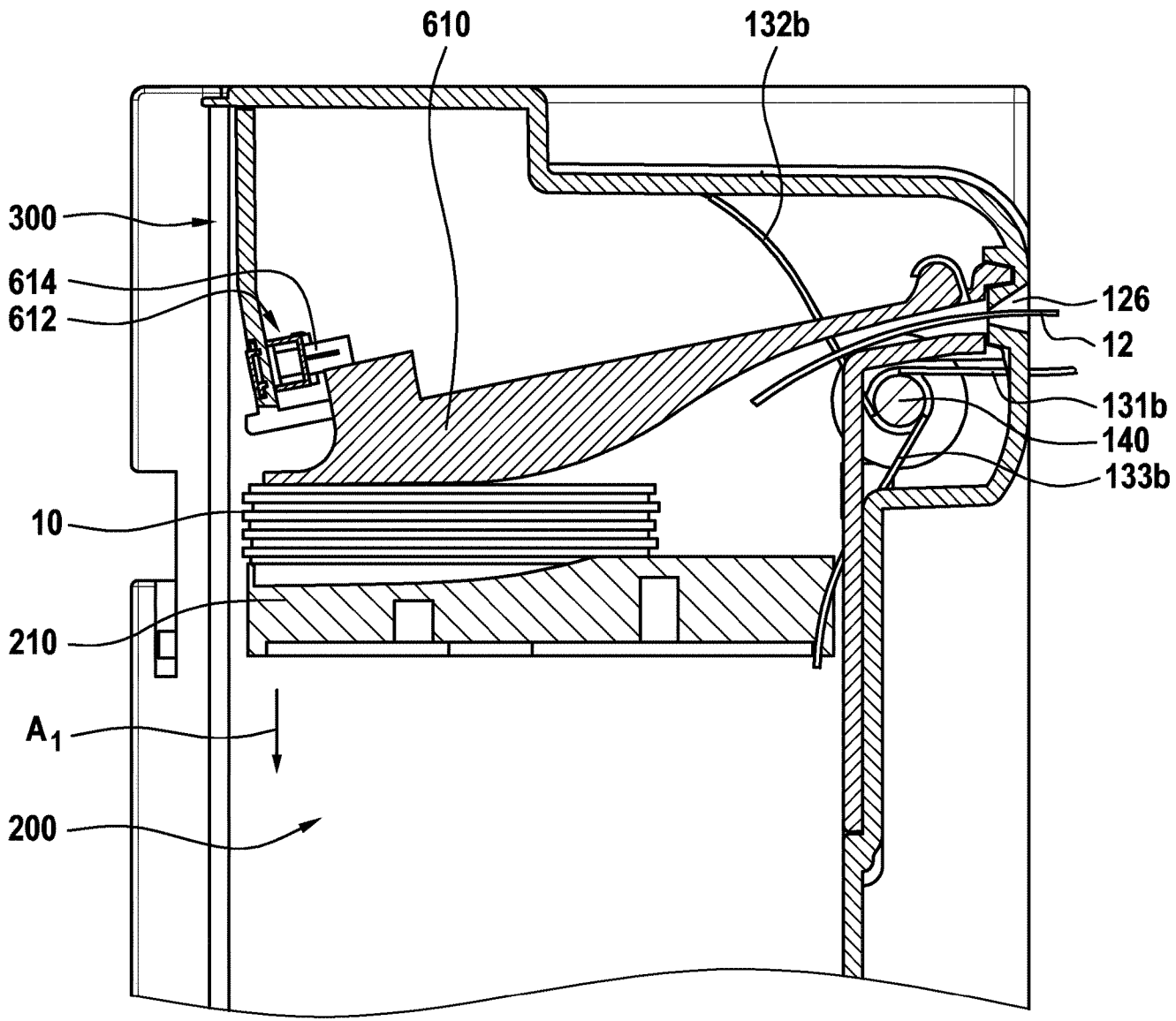
FIG. 9 shows a vertical sectional view according to FIGS. 1 to 8 along the line of section I-I in a fifth operating state.

FIG. 8 shows a vertical sectional view according to FIGS. 1 to 7 along the line of section I-I in a fourth operating state in which several notes of value 10 are fed to the storage area 200 of the cash box 100. FIG. 9 shows a vertical sectional view according to FIGS. 1 to 8 along the line of section I-I in a fifth operating state in which a further note of value 12 is fed to the cash box 100. In FIG. 8, the notes of value 10 deflect the sensor element 610 opposite to the direction of deposit A1 out of the recess 620 into its first sensor element position in which the light beam between the transmitter 614 and the receiver 616 is interrupted by the sensor element 610. In contrast to the second and the third operating state, the counterpressure unit 210 is not in the position P0.

The receiver 616 transmits the first sensor signal indicating that the sensor element 610 is in the first sensor element position to the control unit 500. The control unit 500 subsequently controls the drive unit 400 for driving the counterpressure unit 210 such that it moves the counterpressure unit 210 in deposit direction A1 until the sensor unit 600 transmits the second sensor signal to the control unit, which second sensor signal indicates that the sensor element 610 is no longer in the first sensor element position. FIG. 9 shows the operating state in which the sensor element 610 is no longer in its first sensor element position so that above the value note stack a feed gap is formed into which a new note of value 12 is fed to the cash box 100.

In an alternative embodiment, instead of the light barrier arrangement 612 an analogous detection element for detecting the sensor element position may be provided. Alternatively, the sensor unit 600 may also comprise a digital detection element detecting more than two different positions of the sensor element 610. In alternative embodiments, the sensor element 610 may be arranged displaceably in the feeding unit and/or a spring force may be applied thereto, which biases the sensor element 610 in the direction of the storage area 200.

What is claimed is:

1. A cash box comprising a storage area in which several notes of value are storable as a value note stack, a counterpressure unit which delimits the storage area and is movable in a deposit direction and opposite to the deposit direction between a first position in which the storage area has a minimum volume and a second position in which the storage area has a maximum volume, a sensor unit with at least one sensor element, at least one optical transmitter, and at least one optical receiver, the sensor unit outputting a sensor signal that is dependent on the position of the sensor element, said sensor unit further having said optical receiver positioned to confront said optical transmitter and thereby directly receive a light beam emitted by said optical transmitter, said sensor unit configured to transmit a first sensor signal corresponding to a first position of said sensor element and a second sensor signal corresponding to a second position of said sensor element to a control unit, the counterpressure unit has a recess for receiving at least a part of the sensor element, wherein the sensor element and the recess are arranged and designed such that the sensor element is only received in the recess whenever the counterpressure unit is in the first position and no note of value is present between the sensor element and the recess, wherein said sensor element is further arranged such that it is positioned between said optical transmitter and said optical receiver to block said light beam while at least one note of value is present between said sensor element and said recess, wherein said sensor element is further arranged such that it is not positioned between said optical transmitter and said optical receiver to block said light beam when there are no notes of value present between said sensor element and said recess, wherein said sensor unit outputs said first sensor signal while at least one note of value is present between said sensor element and said recess and said sensor unit outputs said second sensor signal when no note of value is present between said sensor element and said recess, said control unit determines on the basis of said sensor signal of said sensor unit and the position of the counterpressure unit whether said cash box is empty, wherein a drive unit for moving the counterpressure unit is provided, in particular an electric motor, such as a direct current motor or a stepper motor, wherein the control unit determines with the aid of a step counting of the stepper motor the position of the counterpressure unit.

2. The cash box according to claim 1, wherein the sensor unit detects a first sensor element position of the sensor element when at least one note of value is present between the sensor element and the counterpressure unit, the note of value contacts the sensor element with its front or back, and wherein the sensor element is moved opposite to the deposit direction by the contact with the note of value.

3. The cash box according to claim 2, wherein the control unit detects the condition 'cash box empty' when the counterpressure unit is in the first position and the sensor element is not in the first sensor element position.

4. The cash box according to claim 2, wherein the control unit detects the condition 'cash box not empty' when the counterpressure unit is in the first position and the sensor element is in the first sensor element position.

5. The cash box according to claim 1, wherein several notes of value stored in the storage area form a value note stack, wherein in an operating position of the cash box the notes of value of the value note stack are arranged on top of one another such that the lowest note of value rests on the counterpressure unit with its front or back.

6. The cash box according to claim 1, wherein during the feed of notes of value into the cash box the control unit controls the counterpressure unit or a drive unit of the counterpressure unit based on the sensor signal that the sensor element is in the first sensor element position such that the counterpressure unit is moved in the deposit direction until the sensor element is no longer in the first sensor element position and the sensor unit outputs a corresponding sensor signal that the sensor element is in the first position.

7. The cash box according to claim 1, wherein a feeding and/or separating unit for feeding and/or removing the notes of value is provided, wherein the notes of value are feedable or removable individually one after the other to or from the storage area with the aid of the feeding and/or separating unit.

8. The cash box according to claim 1, wherein the control unit determines with the aid of a current measurement of the electric motor the position of the counterpressure unit in which the counterpressure unit bears against a stop.

9. The cash box according to claim 1, wherein the counterpressure unit is firmly connected with at least one belt, the belt being driven by the drive unit.

10. The cash box according to claim 1, wherein the recess of the counterpressure unit has a width of 5 mm to 7 mm, and that the sensor element that is received in the recess has a width of 2 mm to 4 mm.

11. A method for storing several notes of value as a value note stack in a storage area of a cash box, comprising:

delimiting the storage area with the aid of a counterpressure unit, wherein the counterpressure unit is movable between a first position in which the storage area has a minimum volume and a second position in which the storage area has a maximum volume, generating, with the aid of a sensor unit with at least one sensor element, at least one optical transmitter, and at least one optical receiver, a sensor signal that is dependent on the position of the sensor element, receiving the sensor element in a recess of the counterpressure unit when no note of value is present between the counterpressure unit and the sensor element, wherein said sensor unit outputs a first sensor signal while at least one note of value is present between said sensor element and said recess and said sensor unit outputs a second sensor signal when no note of value is present between said sensor element and said recess, providing a drive unit for moving the counterpressure unit, consisting of the following group: a direct current electric motor and a stepper motor, determining, with the aid of a step counting of the stepper motor, the position of the counterpressure unit, and determining, based on the sensor signal and on the position of the counterpressure unit, whether the cash box is empty.

12. The method of claim 11, wherein a determination of the cash box being empty occurs when the counterpressure unit is in the first position and the sensor element is not in the first sensor element position.

13. The method of claim 11, wherein the determination of the cash box being not empty occurs when the counterpressure unit is in the first position and the sensor element is not in the first sensor element position.

14. The method of claim 11, further comprising:

feeding of notes into said cash box;

controlling said counterpressure unit based on the sensor signal that the sensor element is in the first sensor element position, such that the counterpressure unit is moved in the deposit direction until the sensor element is no longer in the first sensor element position, and the sensor unit outputs a corresponding sensor signal that the sensor element is in the first position.

15. The method of claim 11, further comprising:

determining, with the aid of a current measurement of the electric motor, the first position of the counterpressure unit in which the counterpressure unit bears against a stop.

* * * * *